United States Patent [19]

Ho

[11] Patent Number: 4,767,120

[45] Date of Patent: Aug. 30, 1988

[54] MECHANICAL PUZZLE

[76] Inventor: Thomas V. Ho, 14122 205th Ave. N.E., Woodinville, Wash. 98072

[21] Appl. No.: 111,815

[22] Filed: Oct. 21, 1987

[51] Int. Cl.[4] ..... A63F 9/08

[52] U.S. Cl. ..... 273/153 S

[58] Field of Search ..... 273/153 S; 446/487

[56] References Cited

U.S. PATENT DOCUMENTS 4,708,345 11/1987 Ayers ..... 273/153 S

FOREIGN PATENT DOCUMENTS 2116049 9/1983 United Kingdom ..... 273/153 S

*Primary Examiner*—Anton O. Oechsle

*Attorney, Agent, or Firm*—Seed and Berry

[57] ABSTRACT

A manually operable mechanical puzzle including four members, each having separable first and second end body portions. Each body portion has an end connector attached to an outer end for pivotal attachment to one of the other members to form a continuous loop comprised of the four members. The first and second body portions of a member are separably attached together at an inner end for partial rotation about an inner end joint. Each of the body portions has a pair of generally oppositely facing attachment faces, each with a square element rotatably attached thereto by a face joint for partial rotation thereabout. When two of said members are pivoted into position laterally adjacent to each other, the first body portions are rotatable as a unit about a common axis formed by the partial inner end joints to selectively interchange attachments of the body portions. In this position, the elements are formed into sets of four elements in a quadrant-like arrangement, with the set being rotatable about a common axis central of the partial face joints to rotate the set of elements to selectively interchange connections with the body portions.

11 Claims, 4 Drawing Sheets

MECHANICAL PUZZLE

DESCRIPTION

1. Technical Field

The invention pertains to puzzles, and more particularly, to manually operable puzzles in which puzzle pieces are mechanically interconnected but movable relative to each other to permit the user to move the puzzle pieces about to seek a desired pattern.

2. Background of the Invention

In recent years, mechanical puzzles such as the well known Rubik's cube have been providing fun and challenge to the user as he seeks to solve the puzzle. Generally, the puzzle has an original piece pattern indicated by a plurality of color coded pieces which can be moved relative to each other to destroy the pattern. The puzzle user then attempts to rearrange the puzzle pieces to place the pieces back into the original pattern. Because of the many ways of moving and rearranging the pieces, the process of restoring the puzzle to its original pattern presents a challenge and can provide hours of entertainment for both the user and the observer. Organizations have established contests to allow master puzzle solvers to compete, based upon the time required to solve the puzzle. Of course, when puzzle solvers become too familiar with the solution to a puzzle, frustrated with the puzzle or otherwise lose interest, a need is presented for a new puzzle which is unique, challenging and entertaining. The present invention fulfills this need.

DISCLOSURE OF THE INVENTION

The present invention resides in a manually operable puzzle having an even number of pairs of members, including at least four pairs. Each of the members has an arm pivotally connected to an arm of another member for pivotal movement of the pivotally connected members through a common pivot plane. Each member further has an end connector positioned generally opposite its arm and rotatably connected to a mating end connector of the other member of the members for partial rotational movement of the members relative to each other about a common member rotational axis generally parallel to the common pivot plane.

Each member further has a pair of oppositely facing outward faces located between the arm and the end connector thereof. Each of the outward faces has a face connector with a puzzle element selectively rotatably connected thereto by a mating element connector.

The member pairs are selectively pivotable relative to each other through the common pivot plane to bring selected pairs of the member pairs into position laterally adjacent to each other to define a set of four members in a quadrant-like arrangement. One member of the one pair is positioned laterally adjacent to one member of the other pair to define one member grouping of the set and the other member of the one pair is positioned laterally adjacent to the other member of the other pair to define another member grouping of the set. The one member grouping of laterally adjacent members of the set is selectively rotatable as a unit relative to the other member grouping about the common member rotational axis to bring selected outward faces of the one member grouping into position in generally coplanar relation with selected outward faces of the other member grouping of the laterally adjacent members. By such rotation, interchange of the connections of the end connectors of the one member grouping with the other member grouping of laterally adjacent members is accomplished.

The puzzle elements connected to the coplanar outward faces of the four set members define one element grouping of a set of four elements, and are selectively rotatable as a unit relative to the coplanar outward member faces about a common element rotational axis. This axis is generally perpendicular to the common pivot plane to bring the one element grouping into position adjacent to selected ones of the set members. By such rotation, interchange of the connections of the elements connectors of the one element grouping with the face connectors of the coplanar outward faces of the set members is accomplished. As such, the element connector of each of the one element grouping is connected with a corresponding face connector of the selected set members.

Other features and advantages of the invention will become apparent from the following detailed description taken in conjunction with the accompanying drawings.

BEST MODE FOR CARRYING OUT THE INVENTION

Figure 1:
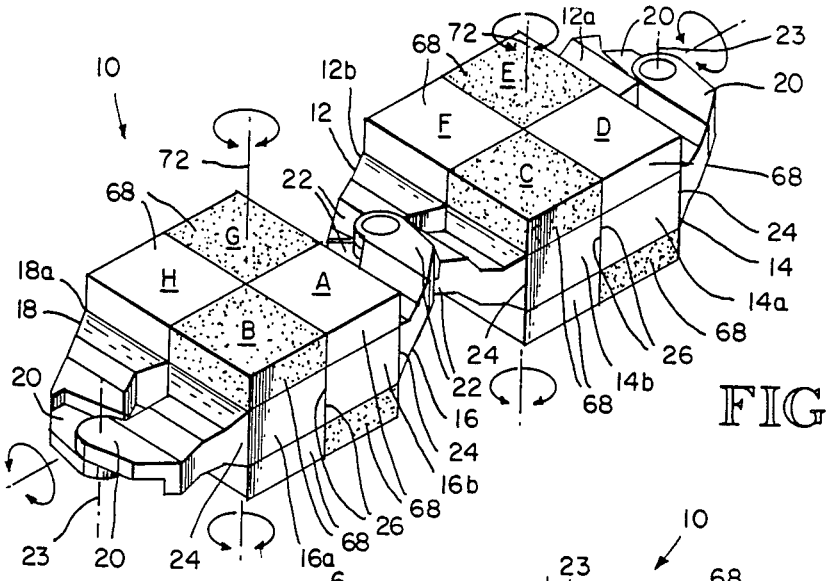
FIG. 1 is an isometric view of a manually operable mechanical puzzle embodying the present invention.

As best shown in the drawings for purposes of illustration, the present invention is embodied in a manually operable mechanical puzzle, indicated generally by reference numeral 10. The puzzle 10 includes first, second, third and fourth elongated frame members 12, 14, 16 and 18, respectively. Each of the frame members has a first body portion and a second body portion, indicated in the drawings by way of example for the first frame member 12 by the use of the letters "a" and "b", respectively, in conjunction with the member reference numeral. As an example, the first and second body portions of the first frame member 12 have reference numerals 12*a* and 12*b*, respectively. Each of the frame members 12, 14, 16 and 18 further has first and second connector arms 20 and 22, respectively, projecting from opposing ends thereof in a generally longitudinal direction.

The first and second body portions for each of the first, second, third and fourth members 12, 14, 16 and 18 are separable from each other in a manner which will be described below, and each has an outer end 24 and an inner end 26. The first connector arm 20 for each of the members is rigidly attached to the first body portion of the member at the outer end 24 thereof. Similarly, the second connector arm 22 for each of the members is rigidly attached to the second body portion of the members at the outer end 24 thereof.

Figure 7:
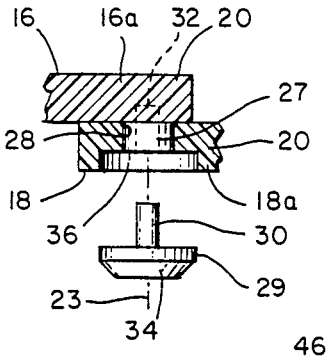
FIG. 7 is an enlarged sectional view taken substantially along the line 7—7 in FIG. 2, with the connector pin shown removed from the puzzle.

As best shown, by way of example, in FIG. 7 for the first connector arms 20 of the first body portion 16*a* of the third member 16 and the first body portion 18*a* of the fourth member 18, the first connector arms are pivotally attached together for relative pivotal movement of the third and fourth members limited to movement through a common plane referred to as the third pivot plane about an axis of rotation indicated in FIG. 7 by the phantom line 23. The pivotal connection is made through a cylindrical stud 27 fixedly attached to and projecting from the connector arm 22 of the first body portion 16*a* into a mating cylindrical bore 28 in the first connector arm 22 of the first body portion 18*a*. A fastening pin 29 is provided having a pin portion 30 which projects through a corresponding bore 32 in the stud 27 and a head portion 34 which is received in a counterbore 36 in the first connector arm 20 of the first body portion 18*a*. The pin 29 prevents disassembly of the pivotal connection. In similar fashion, the first connector arms 20 of the first and second members 12 and 14 are pivotally attached together for relative pivotal movement in a first pivot plane, the second connector arms 22 of the second and third members 14 and 16 are pivotally attached together for relative pivotal movement in a second common plane, and the second connector arms 22 of the first and fourth members 12 and 18 are pivotally attached together for relative pivotal movement in a fourth pivot plane. As will be described in more detail below, the first and second body portions of each of the members 12, 14, 16 and 18 are rotatably attached together for rotation of the first body portions or the second body portions of the members of laterally adjacent pairs as a unit.

Figure 2:
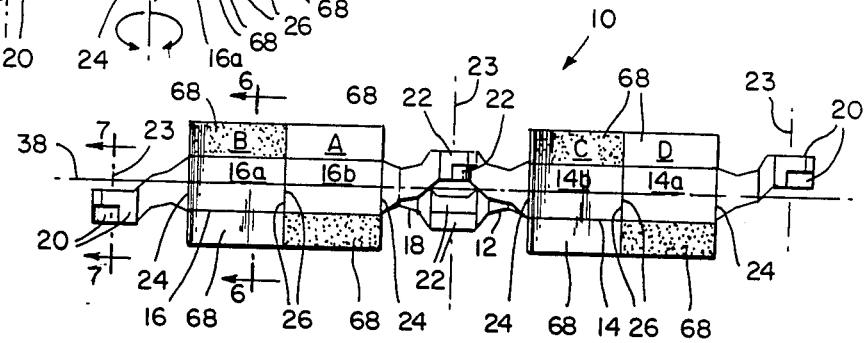
FIG. 2 is a side elevational view of the puzzle of FIG. 1.
Figure 8:
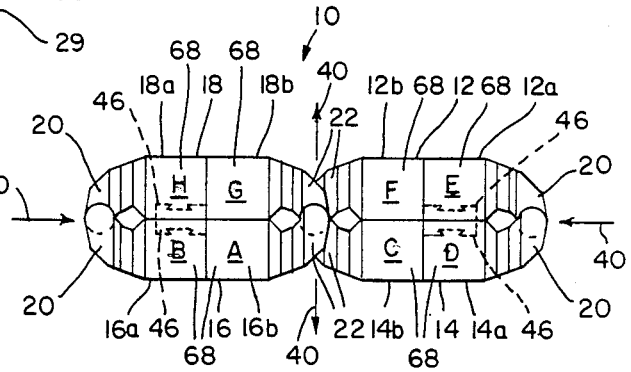
FIG. 8 is a reduced scale top plan view of the puzzle of FIG. 1 shown in a first arrangement.

When the first and second body portions of the members are all rotated to place all four of the first, second, third and fourth pivot planes in coplanar orientation in a common pivot plane 38, indicated as a line in the side view of FIG. 2, the first, second, third and fourth members 12, 14, 16 and 18 are selectively pivotable between first and second arrangements. The first arrangement is shown in FIGS. 1 and 8, and the second arrangement being shown in FIG. 10. As will become clear from the description below, the puzzle 10 is intended for further operation only when in one of these two arrangements. The puzzle 10 is shown in FIG. 9 in an intermediate position as it is being operated to move from the first arrangement to the second arrangement.

In the first arrangement of FIG. 8, the first and second members 12 and 14 are positioned laterally adjacent to each other, and the third and fourth members 16 and 18 are positioned laterally adjacent to each other. The arrows 40 in FIG. 8 show the direction of the movement of the members required to commence rearranging the puzzle from the first arrangement of FIG. 8 to the second arrangement of FIG. 10.

Figure 9:
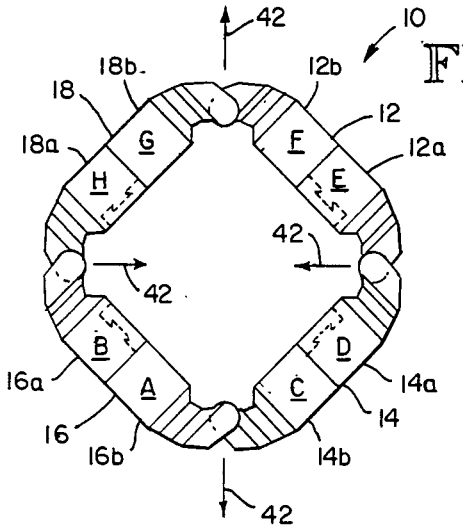
FIG. 9 is a top plan view of the puzzle of FIG. 8 shown in an interim position as it is moved from the first arrangement shown in FIG. 8 to a second arrangement shown in FIG. 10.
Figure 10:
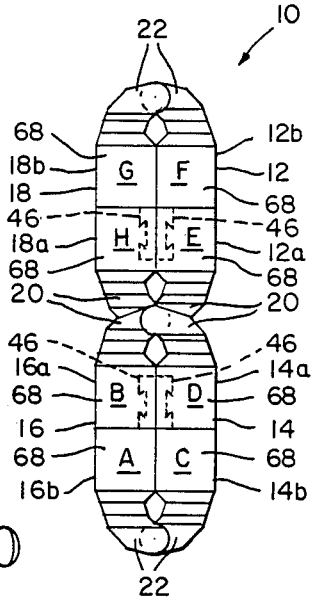
FIG. 10 is a top plan view of the puzzle of FIG. 8, showing the puzzle in a second arrangement.

The arrows 42 in FIG. 9 show the direction of movement of the members as they are being pivoted to move them into the second arrangement of FIG. 10. In this second arrangement of FIG. 10, the first and fourth members 12 and 18 are positioned laterally adjacent to each other, and the second and third members 14 and 16 are positioned laterally adjacent to each other. For purposes which will be described in detail below, it should be noticed that by selectively pivoting the members between the first and second arrangements, it is possible to select two alternative members any one of the members will be positioned adjacent to. By way of example, in the first arrangement of FIG. 8 the first member 12 is positioned adjacent to the second member 14. In the second arrangement of FIG. 10, the first member 12 is positioned adjacent to the fourth member 18.

As best shown in FIG. 2, the first and second connector arms 20 and 22 of the various first and second body portions of the members 12, 14, 16 and 18 project outward from the first or second body portion to which attached and to one side or the other of the common pivot plane 38 of the members. For example, the first connector arms 20 of the first and second members 12 and 14 terminate at a position above the common pivot plane 38, as viewed in FIG. 2. The oppositely positioned first connector arms 20 of the third and fourth members 16 and 18 terminate at a position below the common pivot plane 38. This positioning of the connector arms at different elevations for the oppositely positioned connector arms is necessary so that when the puzzle 10 is moved between the first arrangement of FIG. 8, and the second arrangement of FIG. 10, the connector arms of the members will be positioned to avoid engagement with the other connector arms. For example, if the first connector arms 20 of the first and second members 12 and 14 were positioned at the same elevation as the first connector arms 20 of the third and fourth members 16 and 18, the connector arms would engage each other when being moved into the second arrangement of FIG. 10 and prevent the puzzle from being so moved with the use of different elevations, the first connector arms of the first and second members simply overlap the first connector arms of the second and fourth members.

In similar fashion, the second connector arms 22 of the second and third members 14 and 16 terminate at a position above the common pivot plane 38, as viewed in FIG. 2. The oppositely positioned second connector arms 22 of the first and fourth members 12 and 18 terminate at a position below the common pivot plane 38. In such manner, when in the first arrangement shown in FIG. 8, the second connector arms 22 of the second and third members overlap the second connector arms 22 of the first and fourth members. Thus, the members can be closely positioned together laterally adjacent to each other when in the first and second arrangements.

Figure 5:
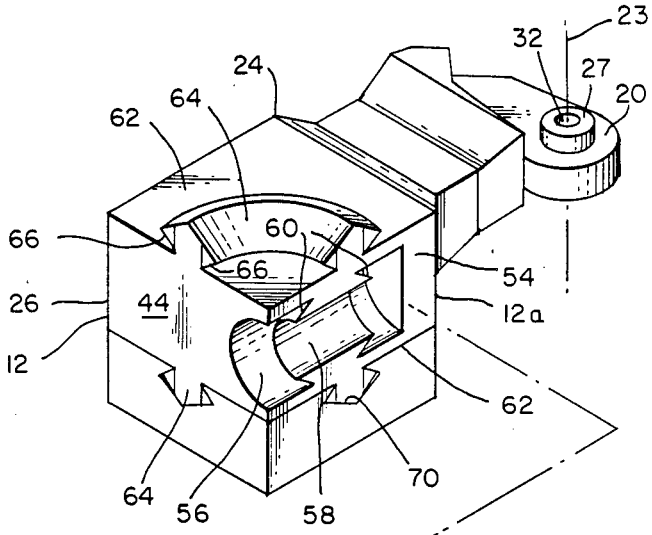
FIG. 5 is an enlarged isometric view of the two body portions of one member of the puzzle of FIG. 1, shown with the body portions disconnected from each other and from the other members of the puzzle.

The basic pivotal arrangement of the first, second, third and fourth members of 12, 14, 16 and 18 of the puzzle 10 have now been described, which is only one of three basic types of movements allowed by the puzzle. The next movement involves rotation of the first or second body portions of laterally adjacent members relative to the corresponding second or first body portions of the same laterally adjacent members. As best shown in FIG. 5 for the first member 12 and by way of illustration for all members, the first and second body portions 12*a* and 12*b* each have an inner end wall 44 with the two end walls being in juxtaposition closely adjacent to each other when the first and second body portions 12*a* and 12*b* are assembled in the original configuration shown in FIG. 1. The first and second body portions 12*a* and 12*b* are rotatably attached together at the inner end walls 44 by a male end connector 46 rigidly attached to the inner end wall of the second body portion 12*b* and projecting longitudinally of the first member 12 beyond the inner end wall of the first body portion 12*a*. The male end connector 46 is a half-round member having a flat side 48 in coplanar orientation with a laterally inner side 49 of the second body portion 12*b*. When the male end connector 46 of the second body portion 12*b* is positioned with its flat side 48 adjacent to and in juxtaposition with a corresponding male end connector of the second body portion 14*b* of the member 14 (when in the first arrangement of FIG. 8) or the second body portion 18*b* of the fourth connector 18 (when in the second arrangement of FIG. 10), in combination a cylindrical, fully-round connector member is formed having a member axis of rotation indicated in FIG. 5 by the phantom line 51.

The male end connector 46 has positioned approximately midway along its length a circumferentially extending groove 50 which has undercuts 52 along both edge sides thereof and which extends about the circumferential half-round portion of the male end connector.

Still with reference to FIG. 5, the first body portion 12*a* has a laterally inward side 54 in which is formed a female end connector 56 with a half-round shape and size to matingly correspond to the male end connector 46 of the second body portion 12*b*. The female end connector 56 is provided with a key 58 which extends about the circumferential half-round portion of the female end connector. The key 58 has undercuts 60 along both edge sides thereof. When the male end connector 46 is positioned within the female end connector 56, the first and second end portions 12*a* and 12*b* of the first member 12 are rotatably and securely attached together except when the first and second body portions are rotated relative to each other about the member rotational axis 51 from the position in FIG. 1 by 180 degrees, whereupon the male end connector 46 and the female end connector 56 are fully disconnected from each other.

Each of the second body portions of the first, second, third and fourth members 12, 14, 16 and 18 is similarly provided with a male end connector 46, and the corresponding first body portion of the member is provided with a mating female end connector 56. When the members are moved into either the first arrangement of FIG. 8 or the second arrangement of FIG. 10, the pivotally connected first or second body portions (depending on the arrangement) of the members which are positioned laterally adjacent to each other, through the combined action of the two male end connectors 46 of the laterally adjacent members and the two female end connectors 56 thereof, are rotatable as a unit through a full 360 degrees of rotation about the member rotational axis 51 relative to the remainder of the puzzle. It is noted that the member rotational axis 51 extends longitudinally, centrally between the laterally adjacent members.

Figure 11:
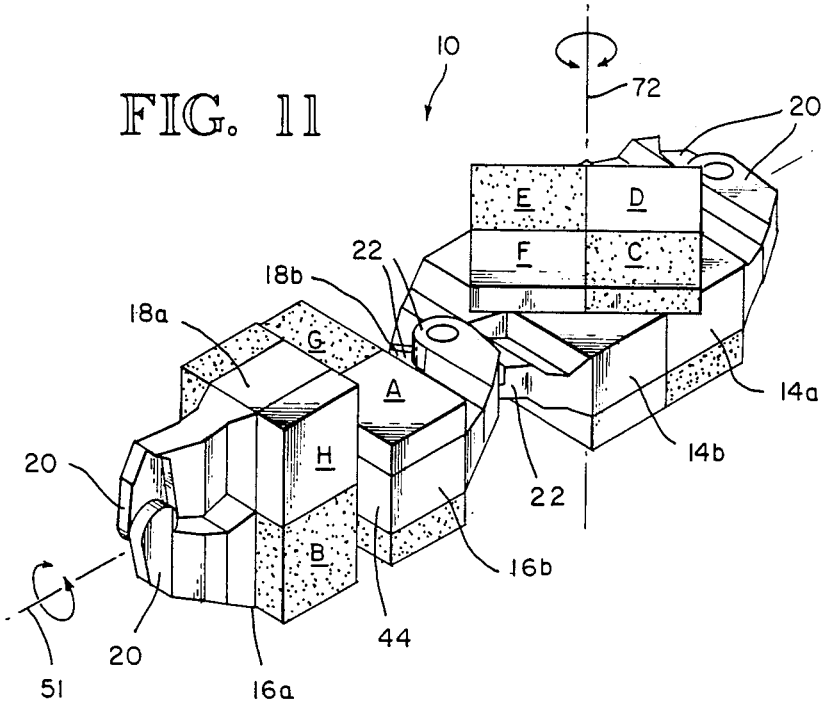
FIG. 11 is an isometric view of the puzzle of FIG. 1, illustrating two operative movements of the puzzle pieces.
Figure 12:
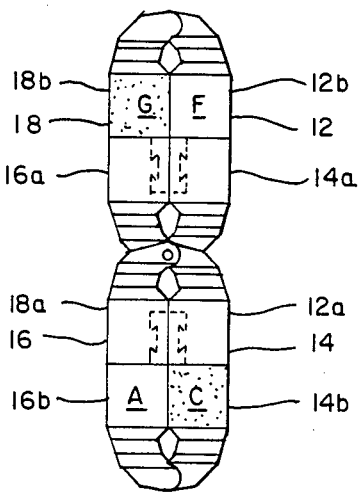
FIG. 12 is a reduced scale top plan view of the puzzle of FIG. 1, similar to the view of FIG. 10, but reconfigured by prior rotation of four puzzle parts.

If a first or second end portion of the laterally adjacent members, again depending on the arrangement of the members, are rotated 180 degrees relative to the second or first body portions thereof, as measured from a position such as shown in FIG. 1, whereat the first, second, third and fourth pivot planes for the first and second connector arms are aligned with the common pivot plane 38, the initial interconnections of the first or second body portions of the laterally adjacent members with the second or first body portions thereof are interchanged. This is best illustrated with reference to FIG. 11 which shows the first body portions 16*a* and 18*a* of the third and fourth members 16 and 18 (as numbered with respect to their original positions as shown in FIG. 1), rotated about the member rotational axis 51 by 90 degrees clockwise. If rotated clockwise through an additional 90 degrees, the first body portion 18*a* which was initially associated with the second body portion 18*b* will have its inner end wall 44 in juxtaposition and adjacent to the inner end wall 44 of the second body portion 16*b*. Similarly, the first body portion 16*a* will have its inner end wall 44 in juxtaposition and adjacent to the inner end wall 44 of the second body portion 18*b*. Because of the use the half-round male and female end connectors 46 and 56, when the first body portions 16*a* and 18*a* are fully rotated to be in positions associated with the second body portions 18*b* and 16*b*, respectively, the puzzle 10 can be pivoted about the first and second connector arms 20 and 22 of the members in the manner previously described with respect to FIGS. 8, 9 and 10 to move the adjacent members apart and into a new arrangement. However, in the example described above, since the first body portions 16*a* and 18*a* have been rotated as a unit relative to the second body portions 16*b* and 18*b*, when the puzzle 10 is pivoted from the first arrangement of FIG. 8 to the second arrangement of FIG. 10, the rearranged puzzle will, in the second arrangement, have reconfigured third and fourth members as shown in FIG. 12. As compared to the configuration shown in FIG. 10, the "third" member will now be comprised of the first body portion 18*a* and the second body portion 16*b*, and the "fourth" member will now be comprised of the first body portion 16*a* and the second body portion 18*b* (see FIG. 12). As will be described in more detail below, not only does this interchange the interconnection of the first and second body portions of the members, but the exterior faces of the first and second body portions are rotated by 180 degrees. The first body portions 12*a* and 14*a* are also shown in FIG. 12 as having been rotated by 180 degrees.

It should be noted that while the operation of the male and female end connectors 46 and 56 have been described with respect to rotation of the first body portions 16*a* and 18*a* as a unit when in the first arrangement of FIG. 8, after the members are pivoted into the second arrangement of FIG. 12 the second body portions 14*b* and 16*b* of the laterally adjacent second and third members can be rotated as a unit, as an example. By being able to rotate the first body portions of laterally adjacent members when in the first arrangement and to rotate the second body portions of laterally adjacent members when in the second arrangements, various reconfigurations of the puzzle 10 can be accomplished.

Figure 3:
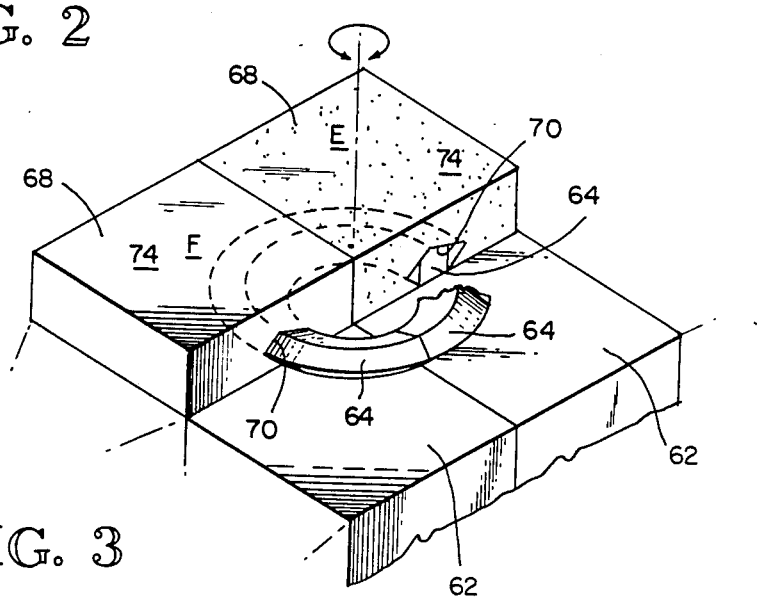
FIG. 3 is an enlarged fragmentary isometric view of the puzzle of FIG. 1.
Figure 6:
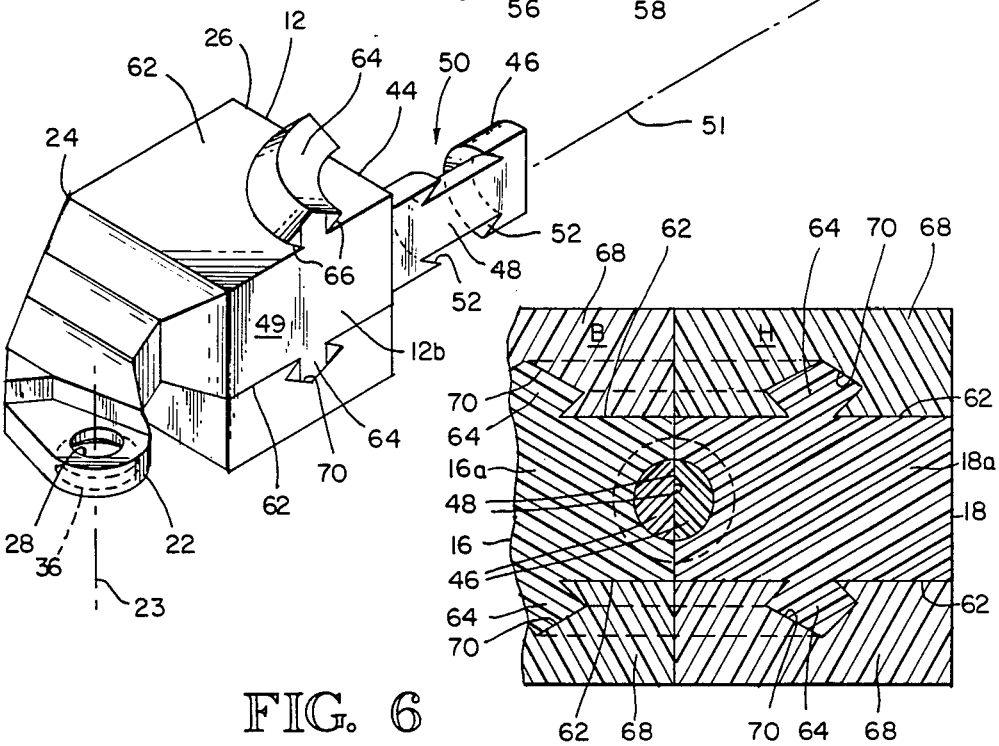
FIG. 6 is an enlarged sectional view taken substantially along the line 6—6 in FIG. 2.

As best shown in FIGS. 3, 5 and 6, the first and second body portions of the first, second, third and fourth members 12, 14, 16 and 18 each has a pair of spaced apart, parallel attachment faces 62 facing in opposite outward directions. The attachment faces 62 of each of the first and second body portions of the members are positioned on opposite sides of the common pivot plane 38 (see FIG. 2) when the members are in the first and second arrangements. The attachment faces 62 of the first and second body portions of the members each has a uniform square shape and extend between the outer end 24 and inner end 26 of the body portion and between the laterally outward side and inward side 49/54 of the body portion. When the members 12, 14, 16 and 18 are in the first or second arrangements of FIGS. 8 or 10, the attachment faces 62 on each face side of the first and second body portions of each pair of the laterally adjacent members are coplanar relation in a quadrant-like arrangement.

Each of the attachment faces 62 has a quarter-circle track 64 rigidly attached to an inward corner thereof so that in combination with the tracks 64 of the attachment faces 62 on the same face side of the first and second body portions of a pair of laterally adjacent members, a circular track is formed extending 360 degrees. Each of the tracks 64 has undercuts 66 along both edge sides thereof.

A block-shaped puzzle element 68 is positioned adjacent to each of the attachment faces 62 and is rotatably attached thereto by the track 64 of the attachment face at which positioned. Each element 68 has an inwardly opening quarter-circle groove 70 with a shape and size to matingly correspond to the track 64. The groove 70 is shaped to permit rotation of the puzzle element 68 relative to the first or second body portion to which attached, but prevents other movement relative thereto.

Figure 4:
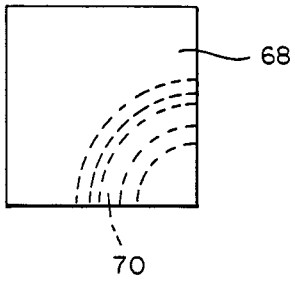
FIG. 4 is an enlarged top plan view of a rotatable puzzle element used with the puzzle of FIG. 1, shown disassembled from the puzzle.

The puzzle elements 68 each have a uniform square shape when viewed in plan (see FIG. 4) equal in size to one of the attachment faces 62. When the members 12, 14, 16 and 18 are in the first or second arrangements of FIGS. 8 or 10, the puzzle elements 68 to each face side of the first and second body portions of laterally adjacent members form a set of four puzzle elements in edgewise adjacent position in a quadrant-like arrangement (see FIG. 11). The set is securely attached to the first and second body portions and rotatable relative thereto as a unit by 360 degrees about an element rotational axis 72 (see FIG. 1) on the combined circular track formed by the quarter-circle tracks 64. The element rotational axis 72 for each of the sets of puzzle elements extends perpendicular to the common pivot plane 38 and through the center of the circular track formed by the combination of the quarter-circle tracks 64 attaching the set.

The set of puzzle elements 68 is rotatable as a unit relative to the first and second body portions to interchange interconnections of the puzzle elements comprising the set to the first and second body portions. The puzzle elements 68 are securely attached to the first or second body portions by the quarter-circle track 64 as it rotates until rotated by 90 degrees, relative to an original position in which it is in alignment with one of the attachment faces 62, whereupon the puzzle element will be disconnected from the first or second body portion to which it was originally attached and aligned, and will be attached to an adjacent first or second body portion and in alignment with attachment face 62 thereof. When the puzzle elements 68 are so positioned each disconnected from all but one of the attachment faces 62, the first, second, third and fourth members 12, 14, 16 and 18 are free to be pivotally moved between the first and second arrangements of FIGS. 8 and 10, with the puzzle element 68 traveling with the first or second body portion to which it has been rotated and is then attached. It is noted that the puzzle elements 68 to one face side of the first and second body portions of laterally adjacent members can be selectively rotated through 90 degrees, 180 degrees, 270 degrees or 360 degrees to selectively change interconnection of the puzzle element of the set. Of course, in the case of 360 degrees rotation the set is rotated in a full circle back to its starting position.

For purposes of illustration, each of the puzzle elements 68 to the upwardly facing face side of the first and second body portions shown in the drawings is labeled with one of the letters A through H. The puzzle elements 68 of the four element set for the laterally adjacent first and second members 12 and 14 in the original configuration shown in FIGS. 1 and 8 are labeled C, D, E, F. Rotation of this set as a unit is shown in FIG. 11. The puzzle elements of the other set for the third and fourth members 16 and 18 are labeled A, B, G and H. It should be noted that as the first, second, third and fourth members 12, 14, 16 and 18 are pivotally moved between the first arrangement of FIG. 8 and the second arrangement of FIG. 10, the composition of the sets changes. As noted above, the one set shown in FIG. 8 includes the puzzle elements C, D, E and F, but when the members are pivoted into the second arrangement of FIG. 10, the set is broken up and the composition of the set changed. In the second arrangement, the reconfigured set which included the puzzle elements C and D now also includes the puzzle elements A and B, rather than puzzle elements E and F. Similarly, the other reconfigured set wheel included the puzzle elements E and F now also includes the puzzle elements G and H, rather than puzzle elements C and D.

In addition to the puzzle 10 providing the ability to change the combination of the sets of puzzle elements 68 as the members 12, 14, 16 and 18 are pivotally moved between the first and second arrangements of FIGS. 8 and 10, rotation of the first or second body portions of laterally adjacent members, depending upon whether the puzzle is in the first or second arrangement, will cause the pair of puzzle elements attached thereto to also be rotated 180 degrees to transfer these puzzle elements from the set on the one face side of the laterally adjacent members to the set on the other face side thereof. The previously described example involving rotation of the first body portions **16*a* and 18*a* about the end connectors 46 and 56 of the third and fourth members 16 and 18 illustrates this action (see FIG. 11). As can be seen from FIG. 12, the result of such a rotation is not only to transfer the puzzle elements H and B to the opposite face side of the first body portions 16*a* and 18*a* (i.e., the downwardly facing face side as viewed in FIG. 12), but to also disassociate the puzzle elements H and B from each other and place them in separate sets. Rotation of first body portions 12*a* and 14*a*** is shown with a similar result for puzzle elements D and E.

In the presently preferred embodiment of the invention, the puzzle elements 68 each have a planar outward facing face surface 74 with each of the face surfaces of the puzzle elements being spaced apart from the corresponding attachment face 62 by an equal distance and parallel thereto. As such, face surfaces 74 of the puzzle elements 68 of each set are in coplanar orientation with each other, and with the other set on the same face side of the members. Furthermore, when the first or second body portions of laterally adjacent members are rotated about the end connectors 46 and 56, the face surfaces 74 of puzzle elements moved from a set on one face side to a set on the opposite facing face side will be in coplanar orientation therewith.

With the puzzle 10 of the present invention, the user can selectively pivot the first, second, third and fourth members 12, 14, 16 and 18 between the first and second arrangements of FIGS. 8 and 10, can selectively rotate pairs of pivotally connected together first and second body portions of laterally adjacent members, and can selectively rotate sets of puzzle elements to provide a large variety of combinations of puzzle elements and movement paths. This allows the puzzle elements to be effectively moved about as desired among the four sets of puzzle elements that exist when the members are in the first or second arrangement. It is noted that four sets of puzzle elements involved when the puzzle is in the first or second arrangements of FIG. 8 or 10, two on each face side of the members and each set has four elements. As such, the puzzle 10 provides a fascinating object for both amusement and serious challenge as one attempts to move the puzzle pieces into a desired pattern.

As with other puzzles, the puzzle pieces may be color coded to define an original pattern, and then scrambled by the user randomly operating the puzzle. The challenge is then to operate the puzzle to move the puzzle elements about from set to set to achieve the original puzzle pattern. With the puzzle 10 the user is not limited to simply moving a piece about the surface of a cube in a single plane in any one movement as with some prior art puzzles, but can move the position of the puzzle element within a set, move the puzzle element to a different set in the same plane, or move the puzzle element to a set in a parallel plane.

It will be appreciated that, although a specific embodiment of the invention has been described herein for purposes of illustration, various modifications may be made without departing from the spirit and scope of the invention. Accordingly, the invention is not limited except by the appended claims.

I claim:

1. A manually operable puzzle, comprising:

first, second, third and fourth members, each said member having a first and second body portions and first and second connector portions, said first and second body portions being separable and each having an outer end and an inner end with said first connector portion attached to said first body portion outer end and said second connector portion attached to said second body portion outer end, said first and second body portions' inner ends being positioned adjacent to each other with said first and second body portions rotatably attached together at said inner ends by an inner end joint for partial rotation thereabout, said first and second body portions each further having a pair of generally oppositely facing attachment faces extending generally between said outer and inner ends, said attachment faces each having an element positioned adjacent thereto with said element rotatably attached to said attachment face by a face joint for partial rotation thereabout, said first member first connector portion and said second member first connector portion being pivotally attached together for relative pivotal movement in a first plane, said second member second connector portion and said third member second connector portion being pivotally attached together for relative pivotal movement in a second plane, said third member first connector portion and said fourth member first connector portion being pivotally attached together for relative pivotal movement in a third plane, and said fourth member second connector portion and said first member second connector portion being pivotally attached together for relative pivotal movement in a fourth plane, when said first and second body portions of said members are rotated to place said first, second, third and fourth pivot planes in substantial parallel arrangement, said first, second, third and fourth members are selectively pivotable between first and second arrangements, with said first arrangement having said first and second members laterally adjacent to each other and said third and fourth members laterally adjacent to each other, and said second arrangement having said first and fourth members laterally adjacent to each other and said second and third members laterally adjacent to each other, when in said first arrangement said partial inner end joints of said first and said second members in combination forming a complete rotation inner end joint fully rotatable thereabout for selective rotation of said first member first body portion and said second member first body portion as a unit about a common axis to selectively interchange the attachments thereof to said first member second body portion and said second member second body portion, and said partial inner end joints of said third and fourth members in combination forming a complete rotation inner end joint fully rotatable thereabout for selective rotation of said third member first body portion and said fourth member first body portion as a unit about a common axis to selectively interchange the attachments thereof to said third member second body portion and said fourth member second body portion, and when in said second arrangement said partial inner end joints of said first and said fourth members in combination forming a complete rotation inner end joint fully rotatable thereabout for selective rotation of said first member second body portion and said fourth member second body portion as a unit about a common axis to selectively interchange the attachments thereof to said first member first body portion and said fourth member first body portion, and said partial inner end joints of said second and third members in combination forming a complete rotation inner end joint fully rotatably thereabout for selective rotation of said second member second body portion and said third member second body portion as a unit about a common axis to selectively interchange the attachment thereof to said second member first body portion and said third member first body portion, when in said first arrangement said partial face joints of said first and second body portions of said first and second members on each said attachment face thereof on each face side in combination forming a complete rotation face joint fully rotatable thereabout for selective rotation of said elements attached on said face side to said first and second body portions of said first and second members as a unit about a common axis to selectively interchange the attachments thereof to said first and second body portions of said first and second members, and said partial face joints of said first and second body portions of said third and fourth members on each said attachment face thereof on each face side in combination forming a complete rotation face joint fully rotatable thereabout for selective rotation of said elements attached on said face side to said first and second body portions of said third and fourth members as a unit about a common axis to selectively interchange the attachments thereof to said first and second body portions of said third and fourth members, and when in said second arrangement said face side joints of said first and second body portions of said first and fourth members on each said attachment face thereof on each face side in combination forming a complete rotation face joint fully rotatable thereabout for selective rotation of said elements attached on said face side to said first and second body portions of first and fourth members as a unit about a common axis to selectively interchange the attachments thereof to said first and second body portions of said first and fourth members, and said partial face joints of said first and second body portions of said second and third members on each said attachment face thereof on each face side in combination forming a complete rotation face joint fully rotatable thereabout for selective rotation of said elements attached on said face side to said first and second body portions of said second and third members as a unit about a common axis to selectively interchange the attachments thereof to said first and second body portions of said second and third members.

2. The puzzle of claim 1 wherein said partial inner end joints for a pair of laterally adjacent members in combination includes means for permitting rotation of said first body portions of both said adjacent members as a unit relative to said second body portions thereof to interchange connection of said first and second body portions of said adjacent members, said means securely connecting together said first and second body portions of said adjacent members during rotation of said first body portions as a unit relative to said second body portions, and when both said first body portions are rotated as a unit relative to said second body portions to a position to interchange connection thereof and with said pivot plane for said adjacent members in substantial parallel alignment with the other of said first, second, third and fourth pivot planes, said means disconnecting said first and second body portions of said one reconfigured adjacent member from said first and second body portions of said other reconfigured adjacent member to permit free pivotal movement of said reconfigured adjacent members.

3. The puzzle of claim 1 wherein said partial face joints of said first and second body portions of a pair of laterally adjacent members in combination includes means for permitting rotation of said elements corresponding thereto as a unit relative to said first and second body portions to interchange connection of said corresponding elements to said first and second body portions, said means securely connecting together said corresponding elements and said first or second body portions during rotation of said corresponding elements as a unit, and when said corresponding elements are rotated as a unit into a position whereat each of said corresponding elements is in substantial alignment with a different one of said first and second body portion attachment faces, said means disconnecting each aligned element from all others of said first and second body portions except said first or second body portion face with which aligned to permit free pivotal movement of said adjacent member about one of said pivot planes and free rotational movement of said first body portions as a unit relative to said second body portions of said adjacent members about one of said rotational axes.

4. The puzzle of claim 1 wherein said first and second body portion attachment faces are of a substantially uniform, generally square shape, and said elements are of a substantially uniform, generally square shape of substantially equal size with said attachment faces.

5. The puzzle of claim 4 wherein when said members are in said first or second arrangements, said elements of said laterally adjacent members attached to each attachment face of said adjacent members form a set of four elements rotatable about said complete face joint as a unit, said elements of said set being positioned edgewise adjacent to each other in a quadrant-like arrangement.

6. The puzzle of claim 5 wherein said elements each have a planar outward facing face with said elements of said set having said element faces in generally coplanar arrangement.

7. The puzzle of claim 6 wherein said common axis of said complete inner end joint attaching said first and second body portions of said adjacent members is positioned midway between said coplanar element faces of said sets attached to opposite attachment faces of said adjacent members and oriented substantially parallel to said coplanar element faces of said sets, whereby rotation of said first or second body portions of said adjacent members as a unit about said common axis by about 180 degrees will bring said element faces of two of said original set on one face side thereof into coplanar alignment with said element faces of two of said original set on the opposite face side thereof to form a newly configured set of the opposite face sides of said adjacent members, and whereby the newly configured set is fully rotatable about the corresponding said complete face joints.

8. The puzzle of claim 7 wherein said element faces of said set attached to one face side of said adjacent members is in generally coplanar orientation with said element faces of said set attached to the corresponding face side of the other of said adjacent members.

9. The puzzle of claim 1 wherein when said first and second body portions are rotated to position said members for selective pivotal movement between said first and second arrangements, said first, second, third and fourth pivot planes are in substantially coplanar orientation to define a common pivot plane.

10. The puzzle of claim 9 wherein selected ones of said first and second connector portions of said first and second body portions extend from said first and second body portions and terminate to one side or the other of said common pivot plane with a pattern to avoid interfering engagement of said connector portions with each other which would prevent positioning of said members in laterally adjacent positions when pivoted between said first and second arrangements.

11. A manually operable puzzle, comprising:

an even number of pairs of members, including at least four of said pairs of members, each said member having an arm pivotally connected to an arm of another member for pivotal movement of each of said pivotally connected together members through a common pivot plane, said members of each said member pair further having an end connector positioned generally opposite said arm and rotatably connected to a mating end connector of the other member of said member pair for partial rotational movement of said members of said member pair relative to each other about a common rotational member axis generally parallel to said common pivot plane, each said member further having a pair of oppositely facing outward faces located between said arm and said end connector thereof, each said outward face having a face connector with an element selectively rotatably connected to each said outward face by a mating element connector, said members being selectively pivotable through said common pivot plane to bring selected pairs of said member pairs into position laterally adjacent each other to define a set of four members in a quadrant-like arrangement, one member of said one member pair being positioned laterally adjacent to one member of said other member pair to define one grouping and the other member of said one member pair being positioned laterally adjacent to the other member of said other member pair to define another grouping, one grouping of laterally adjacent members of said set members being selectively rotatable as a unit relative to the other grouping of laterally adjacent members of said set members about said rotational member axis to bring selected outward faces of said one grouping of laterally adjacent members into position in generally coplanar relation with selected outward faces of said other grouping of laterally adjacent members and to interchange connections of said end connectors of said one grouping of laterally adjacent members with said other grouping of laterally adjacent members, said elements connected to said coplanar outward faces of said set members defining one grouping of elements and being selectively rotatable as a unit relative to said coplanar outward faces about a common rotational element axis generally perpendicular to said common pivot plane to bring said one grouping of elements into position adjacent to selected ones of said set members and to interchange connections of said elements connectors of said one grouping of elements with said face connectors of said coplanar outward faces of said set members for connection of said element connector of each of said one grouping of elements with a corresponding face connector of said selected ones of said set members.

* * * * *